US006067757A

United States Patent [19]

Olson et al.

[11] Patent Number: 6,067,757

[45] Date of Patent: May 30, 2000

[54] TILT-UP CONCRETE PANEL AND FORMING SYSTEM THEREFORE

[76] Inventors: Timothy Olson, 6455 W. Hardison Rd.; Robert Hardison, 6350 W. Hardison Rd., both of Post Falls, Id. 83854

[21] Appl. No.: 09/252,955

[22] Filed: Feb. 17, 1999

[51] Int. Cl.[7] ..... E04B 2/94

[52] U.S. Cl. ..... 52/125.1; 52/100; 52/105; 52/125.4; 52/585.1; 52/587.1; 52/601; 52/630; 52/800.11; 52/801.1; 249/18; 249/189

[58] Field of Search ..... 52/309.2, 309.9, 52/125.1, 125.4, 742.14, 585.1, 587.1, 601, 630, 800.11, 801.1, 100, 105; 249/18, 189, 190

[56] References Cited

U.S. PATENT DOCUMENTS

| | | | |
|---|---|---|---|
| 3,383,817 | 5/1968 | Gregori . | |
| 3,788,020 | 1/1974 | Gregori . | |
| 4,104,356 | 8/1978 | Deutsch et al. | 52/745.11 X |
| 4,393,568 | 7/1983 | Navarro | 29/432 |
| 4,659,057 | 4/1987 | Felter . | |
| 4,669,234 | 6/1987 | Wilnau . | |
| 4,885,888 | 12/1989 | Young . | |
| 5,351,455 | 10/1994 | Schoonover et al. . | |
| 5,459,971 | 10/1995 | Sparkman . | |
| 5,491,948 | 2/1996 | Harris | 52/596 |
| 5,566,519 | 10/1996 | Almaraz-Iiera . | |
| 5,596,855 | 1/1997 | Batch . | |
| 5,611,183 | 3/1997 | Kim . | |
| 5,657,600 | 8/1997 | Mensen . | |
| 5,692,356 | 12/1997 | Baxter . | |

*Primary Examiner*—Christopher T. Kent
*Attorney, Agent, or Firm*—Keith S. Bergman

[57] ABSTRACT

A concrete wall panel for tilt-up construction provides polymeric peripheral elements defining panel and orifice edges and medial fastening strips extending in the panel between the peripheral elements, all of which remain as part of the finished panel to accept traditional self-penetrating nail, screw and staple fasteners historically used in wood construction. The peripheral elements are of solid configuration to provide a form for pouring plastic concrete that forms the panel embodying them. The fastening strips extend through the panel between opposed panel surfaces and are formed by two initially releasably interconnected elements defining voids therebetween to allow thickness adjustment and convenient placement and support of structural components within the panel. The fastening strips define spaced areas to receive traditional wood fasteners and may carry index strips on opposed exposed surfaces to visually indicate strip location and fastening areas. The peripheral elements allow joinder of adjacent panels with each other and both the peripheral elements and the fastening strips allow joinder of structural elements on one or both panel surfaces by self-penetrating fasteners of wood construction.

20 Claims, 4 Drawing Sheets

60a
58
62
63
59
57
58
62
63
60

31
34
24
35
24
40
29
34
35
40
33
13
28
28a
21
35
21
30

60
24
24
58
23
23
57
62
58
48
60b
22
22

32
33
38
35a
29
28
40
41
35b
39
48
62
58b
58a
61
57

48
58
63
62
57
63
58b

60b 57
60a

TILT-UP CONCRETE PANEL AND FORMING SYSTEM THEREFORE

II. BACKGROUND OF INVENTION

IIA. RELATED APPLICATIONS

There are no applications related hereto heretofore filed in this or any foreign country.

IIB. FIELD OF INVENTION

This invention relates generally to tilt-up concrete wall panels and more particularly to such a panel that has embedded fastening elements that provide peripheral forming and fastening means and internal fastening strips.

IIC. BACKGROUND AND DESCRIPTION OF PRIOR ART

Tilt-up type poured concrete walls have long been known for the building of various structures, especially those of light industrial design in a medial range between wood frame structures and poured in place reinforced concrete structures. Though the history of concrete tilt-up walls has been long and during that history the walls have been improved until they have become increasingly sophisticated and complex, there still remain problems with the structures and with their formation process, especially when used in lighter construction for smaller buildings. The tilt-up form of construction in fact has not become particularly popular nor extensively used in various lighter applications such as small office buildings, low-rise multi-dwelling units and individual residential housing units. The instant invention seeks to provide a type of tilt-up concrete wall and method for its formation which resolve various existing problems to make the construction method more adaptable to and appealing for such lighter construction.

Concrete panels not formed in place have long presented problems in connecting adjacent panels to each other and in connecting ancillary structural elements to the concrete panels. Though many and various methods of making such interconnections have become known, none have been so simple nor so standardized as the traditional nail or screw type self-penetrating fasteners used in wood frame construction. Since much lighter construction of smaller buildings and dwellings has been carried out by persons familiar with the traditional fasteners and fastening procedures used with wood frame structural elements, the use of preformed concrete panels, and especially those of the tilt-up type, has not become common in such lighter construction because of the difficulty and lack of familiarity and facility in dealing with past concrete panel connectors. The instant tilt-up panel solves this problem by providing fastening elements about peripheral and orifice edges of the panel and fastening strips in the medial portions of the panels that all are formed of polymeric material that accepts traditional self-penetrating type fasteners applied in traditional fashion such as has historically been done in past light frame construction. The use of such fastening elements does not negate the use of traditional concrete panel interconnections with each other or with other structural elements, but is compatible with such interconnections.

Heretofore when traditional nail or screw fasteners have been used with concrete panels, fastening elements have been established in the panels to receive the fasteners, but it often has been a problem to locate the fastening elements after panel formation for positioning of fasteners. The instant fastening strips solve this problem by providing elongate fastening areas of linear array that may be in parallel relationship with traditional spacings similar to studs in a wall of traditional light frame construction. Additionally each fastening strip may be provided with visually exposed positioning tape that carries indicia indicating the position of fastening elements defined by the fastening strips so that the fastening elements may be readily located for use.

An additional problem with the use of concrete panels in lighter construction in the past has been in providing an economical method for forming the peripheral edges of the panels and orifices defined therein for concrete placement and finishing. Various reusable, normally modular forming systems have heretofore become known, but these systems have generally been relatively expensive and have required substantial expertise for their use, both of which have prevented general acceptance of the systems. Since tilt-up wall formation for lighter construction generally is carried out at a building site to obtain greater economic benefits, most such wall panels have heretofore been formed with forming members, especially of wood, which generally have not been reusable, at least to any substantial degree or over any substantial period. The instant wall panel solves this problem by using the peripheral fastening elements as forming members that remain permanently embedded in the panel that they form. There is no necessity for additional forming elements that do not become a part of the ultimate panel structure and the process therefore provides a lower cost formation process that avoids waste of forming material. An additional ancillary benefit allows such peripheral fastening elements to be particularly configured to accept cooperating form braces that are simple of placement, easily aligned and multiply reusable. The configuration provided in the exterior surface of the peripheral elements to allow fastening of form braces also provide structure that can carry adhesive caulking compounds to aid the insulation and joinder of the edge portions of adjacent concrete panels to each other.

The internal fastening strips are compound structures having two outer surface elements joined in their medial portions, either directly to each other or proximally with a filler strip therebetween, to adjust to and accommodate different concrete panel thicknesses. This structure provides orifices between the opposed surface elements and their connecting structures to allow passage and support of various secondary structural elements that commonly are associated with concrete panels, such as elongate reinforcing bars, electrical wires and junction boxes, plumbing pipes and structures and the like. The connecting elements of the fastening strips are designed to provide chairs for support of these secondary structural elements in the medial portion of a panel, while at the same time providing exposed surface fastening structures to receive traditional fasteners. Fastening strips that have a surface strip on only one side may be used to provide a uniform concrete surface is on one panel side, if desired.

The forming structure in addition to providing the benefits indicated in general allows use of the traditional auxiliary elements and processes historically associated with tilt-up concrete panels in their common and habitually familiar forms.

Our invention resides not in any one of these features individually, but rather in the synergistic combination of all of its structures and processes that necessarily give rise to the functions and results flowing therefrom as herein specified and claimed.

III. SUMMARY OF INVENTION

The instant concrete panel for tilt-up construction provides peripheral fastening and forming elements about its edges that remain embedded in the finished panel and medial fastening strips that are embedded in the panel interior to allow fastening of structural elements to the panel and fastening of adjacent panels to each other. The peripheral fastening elements are formable by extrusion of polymeric material in solid configuration to allow their use as forms for the plastic concrete of the panel. The surface of the peripheral fastening elements distal from the concrete of the panel are shaped to releasably receive the form braces to positionally maintain the peripheral elements on a casting surface during the concrete forming process. The medial fastening strips are formed by one surface element having inwardly extending fastening elements or by two similar spacedly opposed surface elements releasably joined by connecting structure that positions the outer surfaces of the surface elements in coplanar relationship with the surfaces of the concrete portion of the panel. The fastening strip connecting structure provides voids to allow placement of structural elements in the concrete of the panel and supports for positional maintenance of these elements during panel formation. None of the elements of our panel prevent or interfere with the use of traditional components of concrete tilt-up panels, nor do the elements interfere with traditional methods of fastening such panels to each other or of fastening other structural components to the panels.

In providing such a product and forming method, it is:

A principal object to provide a poured concrete panel for tilt-up construction that has peripheral fastening elements about its outer and orifice edges that are formed of polymeric material that accepts traditional nail and screw fasteners of light frame construction applied in traditional fashion.

A further object is to provide such a panel wherein the fastening elements are of a solid configuration so that when they are joined to form closed figures about panel edges and orifices the fastening elements create a form for plastic concrete forming fastening elements in the panel.

A further object is to provide such peripheral fastening elements that releasably interconnect plural form braces that maintain the peripheral elements in proper forming array on a forming surface.

A further object is to provide such a panel that has elongate fastening strips embedded in the medial concrete portion to accept traditional self-penetrating type wood fasteners.

A further object is to provide such fastening strips that may carry index strips on the exposed surfaces to indicate strip position and fastening structure location.

A still further object is to create such peripheral elements and fastening strips that may be formed by extrusion or molding from resinous or polymeric plastics, especially those of a reclaimed, filled and foamed nature.

A still further object is to create such a panel that allows attachment and use of traditional surfacing materials of light frame construction and the habitually familiar fasteners and fastening processes of such construction without prohibiting the fastening structures and methods commonly used in present day concrete tilt-up panel construction.

A still further object is to provide such a panel and forming method that are of new and novel design, of rugged and durable nature, of simple and economic use and otherwise well suited to the uses and purposes for which they are intended.

Other and further objects of our invention will appear from the following specification and accompanying drawings which form a part hereof. In carrying out the objects of our invention, however, it is to be understood that its features are susceptible of change in ordering, design and structural arrangements, with only preferred and practical embodiments of the best known mode being illustrated in the accompanying drawings and specified, as is required.

IV. BRIEF DESCRIPTION OF DRAWINGS

In the accompanying drawings which form a part hereof and wherein like numbers of reference refer to similar parts throughout:

Fi re 17 is an orthographic top view of a portion of a spacing tape that may be used to space fastening strips or connecting elements in spaced parallel relationship.

Figures 18, 19, 20, 21, 22, 23, 24:
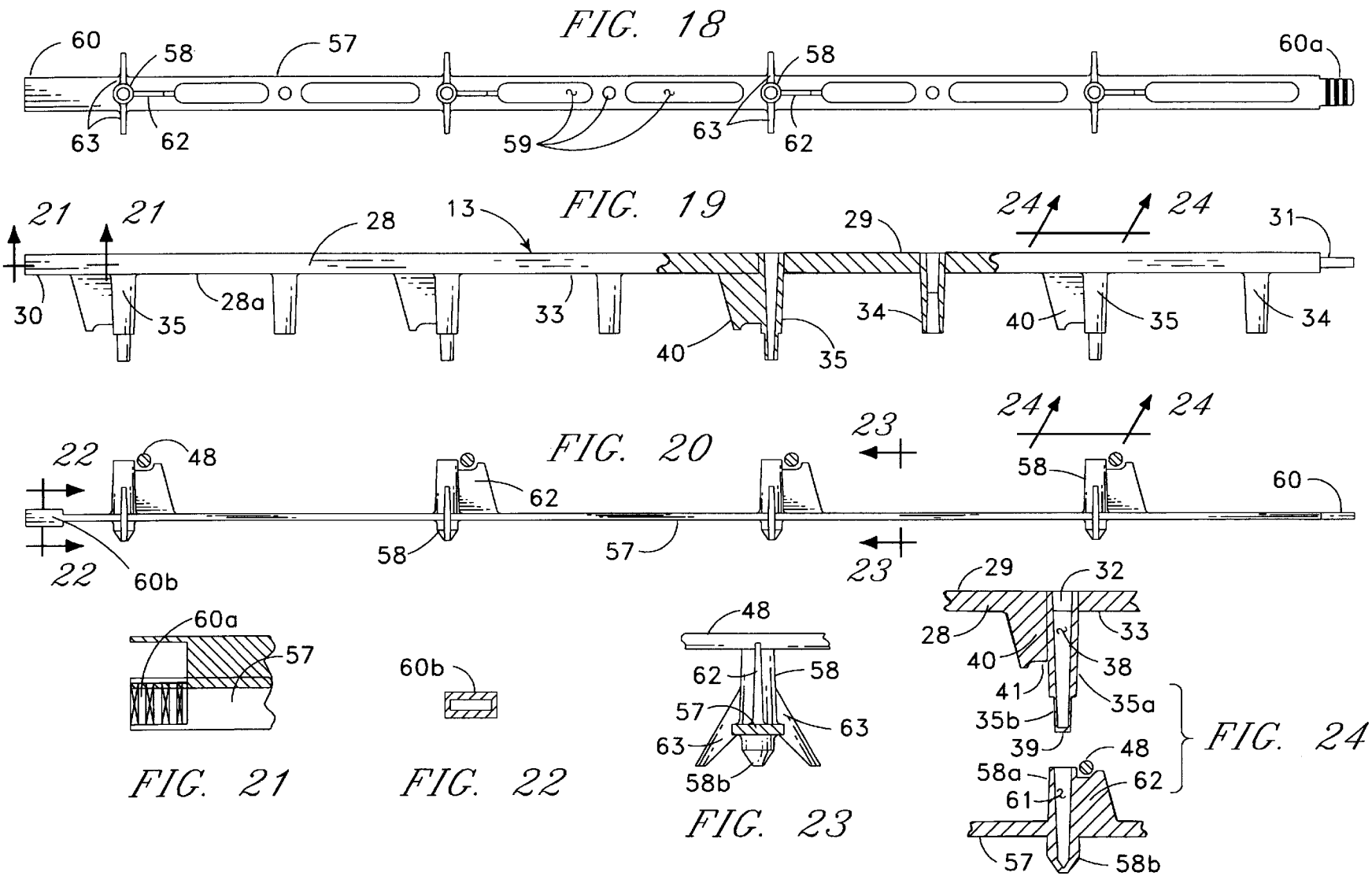

FIG. 18 is an orthographic top view of a species of fastening strip that does not have an exposed surface element.

FIG. 19 is a partially cut-away and expanded elevational view of a fastening strip having an exposed surface element with connecting elements that are releasably interconnected with the surface element.

FIG. 20 is an orthographic elevational view of the fastening strip of FIG. 18 positioned to show how it may be joined with the fastening strip of FIG. 19.

FIG. 21 is a partial horizontal cross-sectional view through the female interconnectable end structure of the surface element of the fastening strip of FIG. 19, taken on the line 21—21 thereon in the direction indicated by the arrows.

FIG. 22 is a vertical cross-sectional view through the female interconnectable end structure of the internal fastening strip of FIG. 19, taken on the line 22—22 thereon in the direction indicated by the arrows.

FIG. 23 is a vertical cross-sectional view through fastening strip of FIG. 20, taken on the line 23—23 thereon in the direction indicated by the arrows.

FIG. 24 is an expanded medial vertical cross-sectional view through two adjacent connecting elements of opposite gender of the fastening strips of FIGS. 19 and 20, taken as on the line 24—24 thereon in the direction indicated by the arrows.

V. DESCRIPTION OF THE PREFERRED EMBODIMENT

Our invention generally provides a concrete panel for tilt-up wall construction having embedded peripheral fastening elements 12 that are fastenable by form braces 11 on a forming surface 10 to serve as forming members, plural embedded fastening strips 13 and embedded auxiliary structural components 14 heretofore known in tilt-up concrete panel construction.

Figures 7, 8, 9, 10, 11, 12, 13, 14, 15, 16:
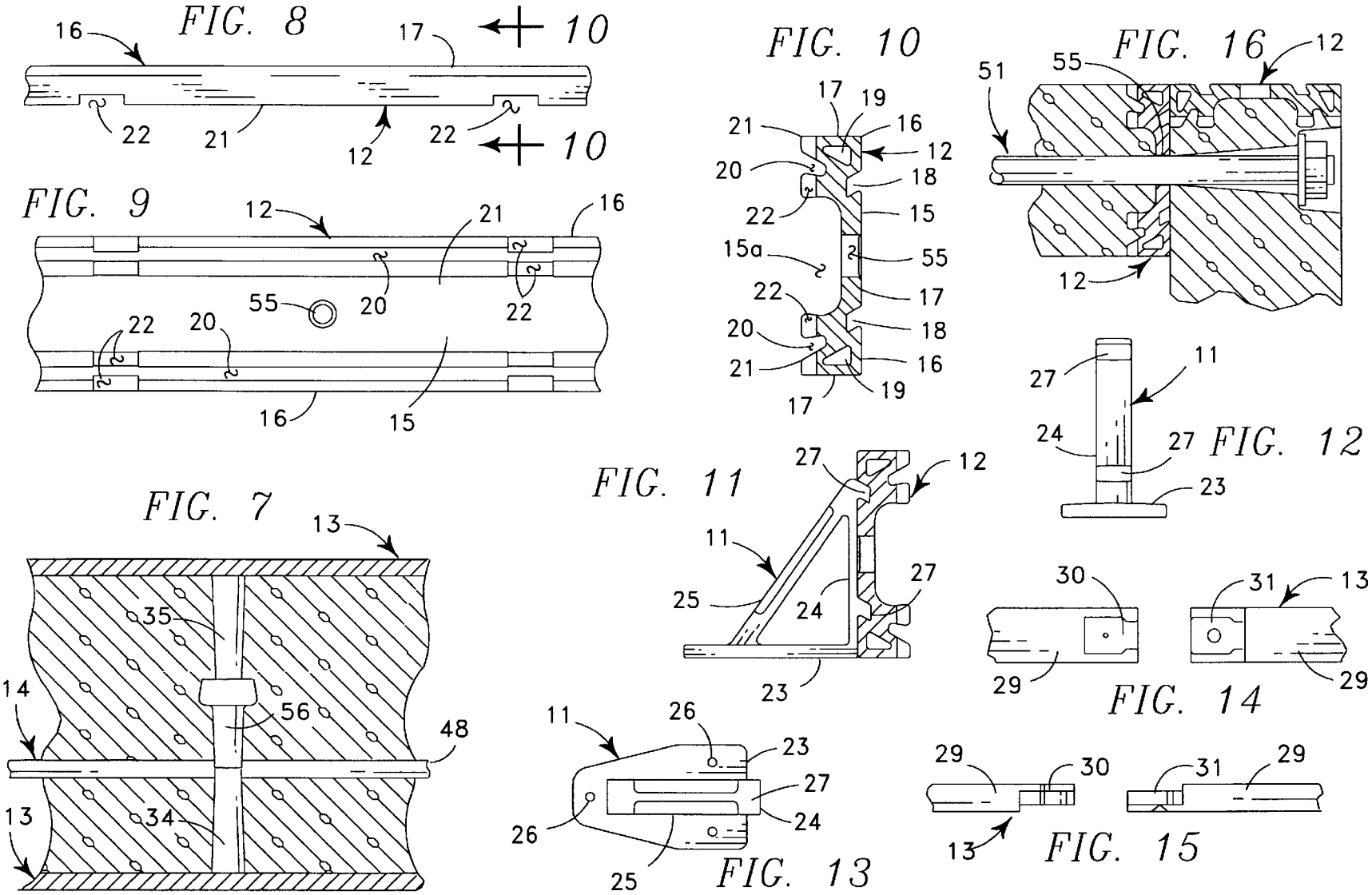
FIG. 7 is a cross-sectional view of a compound connector structure having an extension connector between connectors of two opposed surface elements to expand the thickness of a fastening strip.
FIG. 8 is an orthographic top view of a portion of a peripheral fastening element of our panel.
FIG. 9 is an orthographic elevational view of the inner panel facing surface of the peripheral fastening element of FIG. 8.
FIG. 10 is an enlarged vertical cross-sectional view through the fastening element of FIG. 8, taken on the line 10—10 thereon in the direction indicated by the arrows.
FIG. 11 is a vertical cross-sectional view through a peripheral fastening element with a form brace shown in orthographic side view interconnected therewith.
FIG. 12 is an orthographic elevational view of the inner peripheral fastening element facing surface of the form brace of FIG. 11.
FIG. 13 is an orthographic top view of the form brace of FIG. 11.
FIG. 14 is an orthographic top view of the interconnecting end structures of surface elements of adjacent fastening strips.
FIG. 15 is an orthographic side view of the interconnecting end structures of the surface elements of FIG. 14.
FIG. 16 is a horizontal cross-sectional view through a typical external corner of two panels fastened in perpendicular relationship showing a method of interconnection.

Peripheral fastening elements 12, as seen especially in FIGS. 8–10, are elongate, rigid elements of an extrudable cross-sectional configuration formed by medial body 15 joining similar side elements 16. The outer panel edge surface 17 of the peripheral element is substantially planar but defines spaced parallel fastening channels 18 angulated inwardly and downwardly, when the peripheral element is oriented in a forming position as illustrated in FIG. 11, to receive fastening dogs of form braces. The medial portion of body 15 defines spaced holes 55 having covers with frangible peripheries to allow removal for passage of structural elements, such as rebar and wires to be carried in a panel. The holes 55 preferably are spaced on sixteen inch centers in accordance with prior traditional concrete wall forming practices, but this spacing is not necessary. The side elements 16 are somewhat thicker than the body element 15 to provide a greater fastening area and additional strength and rigidity for the sides while conserving material.

Commonly with this construction, an elongate void or channel 19 will be formed in each side element to conserve material and improve the extrusion characteristics of the peripheral element. The thicker side element structure and thinner medial body structure by their nature define medial channel 15*a* on the inner side of the peripheral element for the same purposes. The inner panel facing surface of side element 16 defines two vertically spaced side channels 20, each extending inwardly in angulated orientation toward each other to provide structure that aids in bonding the peripheral element to adjacent concrete and provides somewhat more uniform thickness of portions of the cross-section of the peripheral elements, again to aid formation of the element by extrusion and conserve material while maintaining appropriate strength and rigidity.

Inner panel facing surfaces 21 of the side elements 16 define plural notches 22 in spaced relationship to receive end portions of fastening strips 13 to aid establishment and maintenance of the positional array of the fastening strips in the panel structure prior to embedment in panel concrete. The notches 22 preferably are arrayed on sixteen inch centers to provide fastening strips in the traditional and habitually familiar spacing of modern day light frame construction, though this particular spacing is neither necessary nor essential and other spacing arrays are within the ambit and scope of our invention. The notches 22 for manufacturing convenience may be created in all peripheral elements, or if desired only in those elements that do receive the end portions of fastening strips for positional maintenance, as commonly the fastening strips extend in spaced parallel array in only one direction in a concrete panel, usually vertically.

Form braces 11, that are releasably fastenable on the outer surface 10 of peripheral elements 12 to positionally maintain the peripheral elements as a forming structure on a forming surface 10, are illustrated particularly in FIGS. 11–13. Each form brace provides horizontal base 23 supporting perpendicularly extending, upright side 24 at the peripheral element facing inner end with angulated support 25 communicating between the upright side 24 and base 23 to provide additional rigidity and strength. The base 23 defines plural spaced holes 26 to receive fasteners (not shown), generally of a double-headed form nail type, to positionally maintain the base on an underlying forming surface. The inner surface of upright side 24 defines vertically spaced, downwardly angulated fastening dogs 27 configured and arrayed to fastenably fit within the two vertically spaced channels 18 of an associated peripheral element to releasably interconnect with that element for positional maintenance on a forming surface.

It is to be noted with this interconnection of form brace and peripheral element that connection will be releasably maintained so long as the two elements are both supported and positionally maintained on a flat forming surface by reason of the downward angulation of both the fastening dogs and the side element channels, but this interconnection is readily releasable when the form brace is disconnected from the forming surface so that it may be removed in an upwardly and outwardly angulated direction.

The form brace 11 is a reusable element by reason of its releasable attachment to both the forming base and a peripheral element and therefore preferably is formed of some reasonably durable rigid material that allows substantial reuse in forming our panels. This material preferably is metal, such as softer steel or a harder aluminum alloy, because of the economy, strength and durability that such materials offer.

Figures 2, 2A, 2B, 2C, 2D, 2E, 2F, 2G, 3, 4, 5, 6, 17:
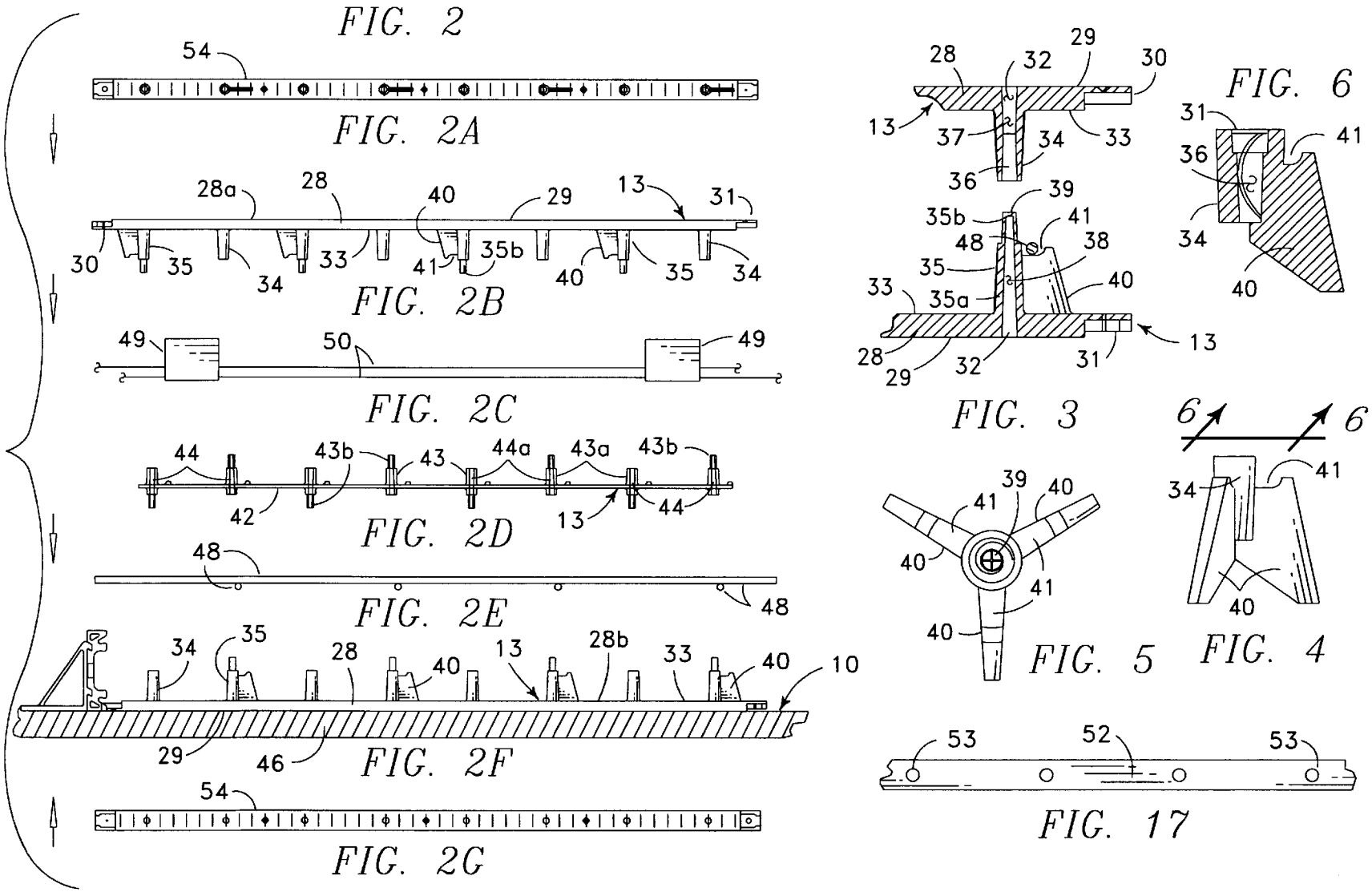
FIG. 2 is an expanded, somewhat diagrammatic view of the various layers of a portion of the wall structure of FIG. 1, taken on a line such as 2—2 thereon in the direction indicated by the arrows, with views of individual layered members and components labeled respectively FIGS. 2A through 2G.
FIG. 3 is an enlarged and expanded medial cross-sectional view of the paired elements of a releasable connector structure extending between two opposed surface elements of a fastening strip.
FIG. 4 is an isometric surface view of a free-standing form of female connector element having support chairs for component structures.
FIG. 5 is an orthographic top view of the connector of FIG. 4.
FIG. 6 is a medial vertical cross-sectional view through the connector of FIG. 4, taken on the line 6—6 thereon in the direction indicated by the arrows.

Fastening strips 13 are shown generally in FIGS. 2 and 18–20. Each fastening strip of the species of FIG. 2 provides spacedly parallel elongate surface elements 28 with planar outer surfaces 29. The end portions of these strips may conveniently, though not necessarily, be formed with connecting structures adapted to interconnect the ends of similar adjacent strips to easily provide compound strips formed by plural elements to provide desired length. One such type of connecting structure is illustrated in FIGS. 14–15 where it is seen to provide interlocking female end 30 that is essentially the mirror image of similar male structure 31 defined in the end of a second surface element to interfit therewith in a fashion that maintains surface element continuity and prohibits elongate or lateral motion of the joined elements relative to each other. This particular interconnecting structure is not novel per se nor essential to our invention and other connecting structures known for the same purposes are within the ambit and scope of our invention.

The surface elements 28 each define plural lineally aligned spaced holes 32, shown in FIG. 3, to cooperate with connecting elements extending between the surface elements to define continuous channels therethrough. The size and spacing of these holes is not critical and may vary while remaining within the ambit and scope of our invention, but necessarily will be dictated by the positioning of connecting elements associated therewith.

The dimensioning of the surface elements 28 is not critical, but they must be wide enough to accommodate structures interconnecting the opposed surface or connecting elements and must provide sufficient strength and rigidity for configurational maintenance during the forming and concrete casting and finishing processes. Preferably the surface elements are approximately 0.75 to 2.00 inches in width and approximately 0.75 to 1.0 inch in thickness when the surface element is formed from polymeric material. The length of the surface elements may be somewhat governed by the formation process therefore, but preferably for either extrusion or molding formation, especially in view of the interconnecting end portions, the length is from approximately four to eight feet.

Inner surfaces 33 of surface elements 28 structurally carry a plurality of similarly spaced, lineally arrayed and alternating female connecting elements 34 and male connecting elements 35. Each female connecting element 34 comprises a truncated conical structure, illustrated especially in FIG. 3, that has its base adjacent the inner surface 33 of the surface element 28 supporting it. The female connecting element 34 defines internal conical channel 36 extending from its inner end portion to an axially medial position with inter communicating cylindrical channel 37 extending outwardly from interconnection therewith to interconnect with one of the holes 32 defined in the surface element 28. The conical channel 36 is designed to provide a self-centering frictional connection with an interconnecting male element and to provide a stop to maintain two connected surface elements in parallel adjacency. The length of the female connectors 34 may vary in our fastening strip, but the distance between the inner end of the connector 34 and the outer surface 29 of surface element 28 supporting it should be related to configuration of the associated male connector so that two interconnected surface elements are coplanar with the opposed side surfaces of peripheral elements with which the surface elements are interconnected.

The male connecting elements 35 provide a body portion 35*a* similar to the female connecting element 34 and similarly oriented on a surface element 28 on a surface element 28, but in addition provides inwardly extending connector portions 35*b* of such smaller diameter and truncated conic configuration as to frictionally fit within channel 36 defined by an opposed inter fitting female connecting element. This construction defines a ridge between body portion 35*a* and conic connector portion 35*b* which fits against the inner end portion of female connector 34 to interconnect two opposed surfacing elements in a predetermined spaced relationship. The male connecting element 35 defines medial channel 38 that extends through both body portion 35*a* and connector portion 35*b*, with frangible web 39 that can be easily removed covering the inner end portion of the channel. The male connecting element 35 is structurally carried on the inner surface 33 of surface element 28 in a position whereat medial channel 38 is positioned over a hole 32 defined in the surfacing element to communicate with that hole.

Either the male or female connecting elements of FIG. 3, may be provided with one or more radially extending fins 40, in the instance illustrated comprising one, to provide additional support for the connector and define a chair structure for support of structural components to be contained within the wall panels, such as steel reinforcing rods and electrical and plumbing conduit. The fins preferably are of somewhat trapezoidal configuration that provides two adjacent fin sides that fit adjacent the outer surface of body portions 35 or 34 and the inner surfaces 33 of the surface elements 28 with the fin extending radially a spaced distance from the body. The inner end portion of one or more fins preferably define a radially inwardly opening notch 41 to aid in supporting structural elements in the panel. The inward projection or length of body portion 35*a* of the male connector preferably is substantially the same as the length of the female connector 34 and the maximum inward extension of fins 40 is preferably somewhat less to maintain structural components in the medial portion of the panel.

Two surface elements 28, as illustrated in FIGS. 2B and 2F, are interconnected to form a complete fastening strip 13. The two interconnected surface elements are arrayed such that a male fastener of one will be adjacent a female fastener of the other and the other spacedly adjacent fasteners will correspondingly be in similar fastenable relationship. It is convenient but not necessary that the end connecting structures 30, 31 at one end of a pair of inter fitting surface elements should be coplanar and of opposite gender so that the surface elements may be joined to form a fastening strip with coplanar ends. The fastening strips 13 may have index tapes 54, shown in plan view in FIGS. 2A and 2G, on outer surfaces 29 to indicate the position of the fastening strips and associated connecting elements to aid positioning of fasteners therein. These index tapes also may have measurement indicia for the convenience of workmen dealing with the fastening strips.

One or more expansion strips may be interfit between two opposed surface elements 28 and their associated connecting elements to increase the distance between the outer surfaces 29 of a connected pair of surface elements to allow formation of concrete panels of thickness greater than that provided by directly interconnecting the fastening elements to each other. In panel structures the peripheral elements 12 will have the same height between the outer surfaces of side elements 16 as do associated fastening strips between the outer surfaces of their surface elements to serve as forming structures with a planar upper surface. One such expansion strip is shown in elevational view in FIG. 2D where it is seen to provide elongate body 42, generally of the same peripheral configuration as the interconnected fastening strips, carrying in linear spaced array a plurality of similar connecting elements 43 with diametrically larger body 43*a* and diametrically smaller connecting portion 43*b* extending from one end thereof. Each connecting element defines medial channel 44 extending therethrough, with the channel portion 44*a* defined in body portion 43*a* of the same configuration as the channel of a female connecting element 34 and the connecting portion 43*b* of the same configuration as the connecting portion 35*b* of a male connecting element 35. The fasteners 43 are arrayed in alternating lineal spaced array, with a first similar set having male connecting elements projecting on a first side of the elongate body 42 and a second similar set having male connecting elements projecting on the second side of the elongate body. All bodies of both sets are coplanar so as to interfit between the connecting elements of a pair of spacedly opposed surface elements 28 to interconnect those elements while maintaining the associated surface elements in parallel relationship.

As shown in FIG. 7, connecting elements may be extended and two opposed surface elements interconnected by individual connecting elements 56 not interconnected with each other by a body structure such as element 42, when such individual connecting elements are arrayed in connecting orientation between two opposed connecting elements of opposite gender. With such individual connecting elements 56 not all opposed pairs of connecting elements need be so interconnected, but the individual connecting elements may be variously spaced throughout a set of joined connecting elements. This method of interconnection with individual connecting elements is not so simple nor convenient as using an elongate body 42 to carry a plurality of connecting elements and the use of such individual connecting elements is generally more time consuming.

A second species of fastening strip that does not provide surface elements on a surface of a concrete panel, but yet allows the use of fastening strip having surface elements on the opposite side, is shown in FIGS. 18 and 20 where it is seen to comprise connecting strip 57 having spaced lineally array connecting elements 58. The connecting strip 57 is a relatively thin, elongate strip defining plural medial orifices 59 to conserve material and allow concrete to pass through the strip to aid in preventing voids or non-homogenous areas that might induce spalling of the concrete and to better bond the spacing strip in the concrete. The ends of each connecting strip preferably provide connecting structures 60 of opposed male 60*a* and female 60*b* gender to releasably interconnect a linear array of similar fastening strips. The nature of these connecting structures is not critical nor are they necessary to the use of our forming system, and other known connectors that are adaptable for such purpose are within the ambit and scope of our invention.

Connecting elements 58 of this second species of fastening strip provide truncated conical body portion 58*a* extending spacedly inward into the panel and outer support portions 58*b* extending spacedly outwardly from the connecting strip 57 to provide support on a forming surface. The support portions 58*b* have truncated conical points so that the portion contacting a supporting surface is minimal to leave no noticeable markings in a finished panel surface. The connecting elements 58 define medial conical channel 61 to receive a male connector in its inner end portion and provides an outer end portion with a frangible cover that may be opened by drilling, punching or the like after panel formation to create a channel through the panel to aid in releasing it from a forming surface, if necessary.

The connecting element 58 preferably carries at least one support chair 62 to support structural elements within a concrete panel embodying it. This support chair is substantially the same as that described hereinbefore for use with fastening strips having exposed surface elements. Two angulated depending legs 63 are carried by the body to depend in diametrically opposed array to aid in supporting the connecting elements on an underlying forming surface. The outer portions of these legs are coplanar with the outer truncated end of the associated portion 58*b* of connecting elements. As illustrated in FIG. 20, the connecting elements are spaced so that the female connecting channels defined by the inner body portions will be adjacent the male connecting elements of a surface element 28 having an exposed surface as heretofore described.

Such an ordinary surface element 28 is illustrated in FIG. 19, in spaced adjacency to the connecting strip 57 of FIG. 20, to show how the two elements are interconnectable to provide a complete fastening strip in a concrete panel, but yet have a surface element on only one side of the panel. This surface element 28 carries spaced alternating female connecting elements 34 and male connecting elements 35 extending into a panel in the same fashion as heretofore described for a fastening strip having two opposed surface elements. The only difference in this particular fastening strip from that shown in FIG. 2B is that in this instance the male and female connecting elements 34, 35 are formed separately and held in surface element 28 by frictional interconnection therewith as shown in the cut-away expanded portion of FIG. 19. The unitary fastening strips of FIGS. 2B and 2F generally are preferred and more simple of both use and manufacture, but in some instances removable connecting elements may be desirable and they are within the ambit and scope of our invention.

The interconnection of surface element 28 of FIG. 19 with the connecting strip 57 of FIG. 20 is shown especially in the enlarged expanded cross-sectional view of FIG. 24, where it is seen to function in substantially the same fashion as the interconnection of connecting elements carried by two surface elements each having exposes surfaces. For any practical utility, the connecting strip portion of a fastening strip must be positioned on the lower surface of a panel to be cast so that it may be supported directly upon an underlying forming surface. This second species of fastening strip provides substantially the same potential for the acceptance of fasteners and their positional maintenance on the panel side carrying the surface element as does a fastening strip having surface elements on both panel sides.

A form of free standing connecting element without any connection between connecting elements is illustrated in FIGS. 4–6. Two or more of this free standing type of connecting elements may be used with a surface element such as that of FIG. 2B to provide a fastening strip with a surface element on only one side. The particular female connecting element illustrated has medial body 34 defining fastening channel 36 that is supported by three equally radially spaced depending legs 40. The orifice of the inner portion of channel 36 of this support is covered by frangible covering element 39 which is removed by a male fastener when inserted into the channel. Though only a female type of free standing connecting element is illustrated, the body portion of the illustrated element may be replaced by a male body (not shown) of the configuration of that of FIG. 3 to form a free standing connecting element for use with female connecting elements 34 of a surface element 28.

These free standing connecting elements may be used in conjunction with a fastening element such as that illustrated in FIG. 2B to support the fastening element with its upper exposed surface 29 on the upper side of a panel to be cast. The advantage of this individual self-supporting connecting element is that the element of either or both genders may be distributed at a user's option to support connecting elements of a fastening strip without having to use a free standing connecting element on each connecting element of a surface element which in some instances may be desirable.

The various portions of fastening strips 13 are formed of polymeric or resinous plastic materials that accept traditional self-penetrating fasteners of wood construction, such as nails, screws, staples and the like, and is amenable to shaping by the ordinary tools of wood frame construction such as saws, drills, routers and the like. The plastic material preferably is foamed and embodies filling material to aid in providing the desired workability characteristics described. A foamed type plastic generally provides a more workable material and it is somewhat more compressible and resilient in accepting traditional wood fasteners. Various known plastic materials are suitable for this purpose and provide a wide range of foaming and filling parameters that result in widely variable characteristics of strength and rigidity. The preferred filling material that synergistically aids establishment of the desired parameters described is particulated cellulosic material of arboreal or herbal origin, commonly waste from the lumber or agricultural industries. Foamed plastic matrix material may be of either open or closed cell type, depending upon desired material characteristics and usage environments.

The various fastening strip members with their connectors generally must be formed by some type of molding process for economic viability, and this to some degree determines the characteristics of both plastic and filling materials. Many known forming processes for plastic materials can be used to manufacture the peripheral elements and fastening strips of our panel structure, but we prefer that the peripheral elements be formed by extrusion type molding with subsequent modification and that the fastening strips be formed by injection molding so that each surface element with connecting elements may be formed at one time without any requirement for subsequent assemblage or joinder of its parts. With either type of formation, the filling material must be such as not to interfere with the molding process and this practically requires that the filling material be of small particulate nature to avoid such interference and allow formation of the elements with geometrically correct configurations.

Having thusly described the structure of our panel, its formation and use may be understood.

Figure 1:
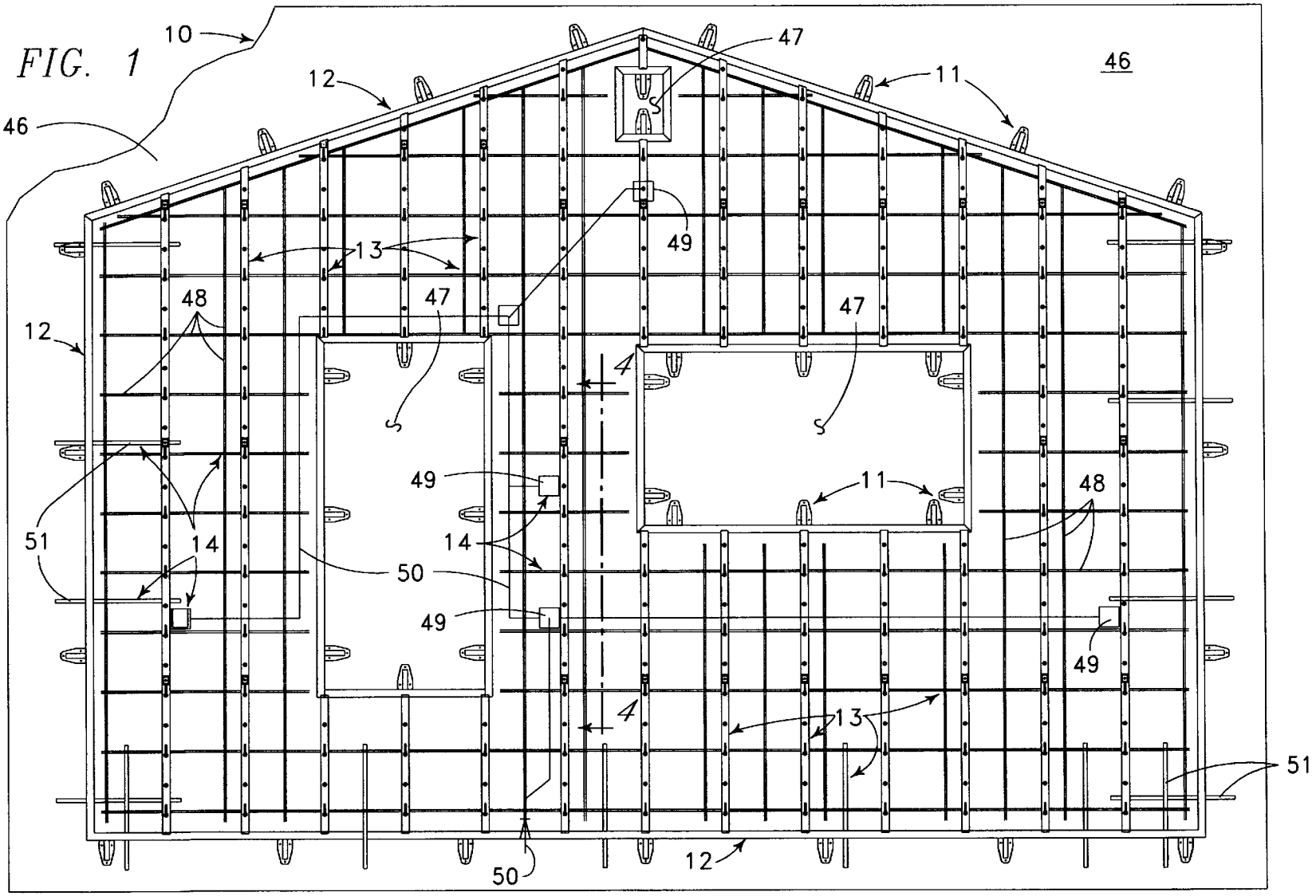
FIG. 1 is an orthographic plan view of an assemblage of peripheral fastening elements, fastening strips and structural elements for a panel on a forming surface ready for concrete pouring.

The method of forming a tilt-up concrete panels with our invention is, in essence at least, substantially similar to the methods that have heretofore been used for forming such panels. A forming or casting surface 46 shown in FIG. 1 is established on a support, normally the earth, in a fashion to create a substantially horizontal planar surface of a size and configuration somewhat larger than a concrete panel to be created. The casting surface normally is formed of wood panels and may have its concrete contacting surface treated with known release agents or covered with polymeric film to form a surface from which a panel to be cast may be easily released without damage. Decorative surfaces on cast panels may be created by appropriate configurational forming processes heretofore known, though commonly a smooth surface is desired on most concrete panels and any decorative material is usually added after creation of the panel by physical attachment.

To establish a panel for forming, peripheral elements of appropriate length are cut to form each of the peripheral edges of the particular wall panel and the edges of any orifices 47 defined therein. The adjoining ends of these peripheral elements are cut to form tight joints, normally in planar angulated configuration with each adjoining surface angled to meet on a medial line defining one-half of the included angle between the adjoining elements. This cutting is accomplished by ordinary sawing or shearing procedures and tools in the same fashion as with wood elements. The peripheral elements then are positioned on the forming surface in appropriate array to form the peripheral and orifice edges of the panel to be created, such as illustrated in FIG. 1. Form braces 11 are attached to the exterior surfaces of the forming elements in spaced relationship as required to positionally maintain the peripheral elements on the casting surface during the casting process. The form braces are attached by positioning them so that the fastening dogs 27 are adjacent notches 22 in the outer surfaces of the peripheral elements and then moving the braces downwardly in an inwardly angulated course so that the dogs engage within the notches 18. The form braces then are fastened to the forming surface by traditional fasteners (not shown), normally double headed form nails, so that the projecting heads allow easy removal. Preferably the form braces are spaced not more than approximately thirty-six inches from each other along the peripheral elements which they engage, but this spacing may be varied as required to provide adequate support for the peripheral elements to positionally maintain them to serve their forming purposes.

Surface elements of fastening strips 13 then are established within the periphery of the peripheral elements on the underlying forming surface and fastened to the peripheral elements where possible. The outer surface 29 of the lower surface element **28*b* is positioned immediately upwardly adjacent the forming surface. The lower panel surface can form either side of a particular panel, but normally does form the outer side when positioned in a peripheral structural wall in accordance with the traditions of present day tilt-up panel construction practices. The lower surface elements of the fastening strips preferably are positioned in spaced parallel array, normally but not necessarily so as to be in vertical orientation in the finished panel. This array of surface elements may be determined and their fastening to the peripheral elements aided by the notches 22** defined in the peripheral elements.

The spaced relationship of a plurality of surface elements may also be easily established and maintained by spacer strips 52 defining spaced holes 53 to fit over lineally adjacent connecting elements 34, 35. These spacer strips, when positioned over a parallel array of connectors perpendicular to the forming elements, will easily establish and maintain the spaced parallelity of the surface elements and provide easy layout on standard construction centers. These strips may be removed before concrete pouring, if desired.

If the surface elements 28 are formed in lengths shorter than required, an appropriate number are joined in lineal array by the end fastening structures 30, 31 to create a compound surface element of appropriate length. Any required cutting or trimming of the surface elements may be accomplished by saws or other cutting tools used in wood construction. The end portions of the surface elements may be interconnected to adjacent peripheral elements with ordinary self-penetrating fasteners such as nails, screws or staples and by known plastic joining methods such as adhesion, plastic welding and the like, if desired.

Any auxiliary structural components required in a particular panel are established in the structure. Traditional steel reinforcing rod or "rebar" 48 is firstly positioned to extend perpendicularly to the fastening strips so that it may be carried on fins 40 of the connecting elements to form a horizontal layer for support of additional rebar form extending angularly to a reinforcing network. Rebar extending angularly to the fastening strips or in perpendicular orientation thereto is positioned on the lower rebar to form a network and the intersections of the rebar elements may be fastened by traditional wire tying, welding or by other known means. Electrical junction boxes 49 required within the panel are positioned together with wires or conduit 50 servicing them or otherwise required. These auxiliary structural components may be supported for positional maintenance on the fastening strip connecting elements or on the reinforcing rod 48, as appropriate, by the use of fastening wire, plastic ties or similar known means heretofore used for such purposes in prior tilt-up concrete panel construction. Traditional spacer blocks heretofore commonly used that had to be removed during or before casting a panel are not required.

Fastening and handling elements 51 are established about the periphery of the frame, as required, with their outer ends projecting through the peripheral elements. Traditionally these fastening elements are rod-like, so-called "pins" or threaded studs 51, but their nature may vary depending on the nature of interconnection that is to be made with adjacent wall panels or supports. These fastening and handling structures are not a part of our invention, per se, and may take the various forms heretofore known for such structures in the existing tilt-up concrete panel art. The fastening elements may be inserted through preformed knock-out type holes 55 in the peripheral elements 12 or holes may be specifically created in the peripheral elements for such fastening structures by drilling with ordinary tools used in wood construction. The inner end portions of such fasteners may conveniently be supported on the rebar network 48, on the fastening strips 13 or both by wire tying or other traditional fastening methods.

Plumbing structures (not shown) such as piping, fixtures and the like may be installed in the panel at this time. Commonly plumbing structures are not contained in concrete tilt-up walls because of practical considerations involved, as often pipes are of substantial size and concrete panels are of limited thickness to create problems with both embedment and structural strength of a panel. Commonly it also is not possible to make connections to pipes within a concrete panel unless a void is created in the panel about the area where the interconnection is to be made. Because of the inconvenience and deleterious structural affects, such voids are not commonly created in panels. Protruding plumbing fixtures that are pre-established to project through a concrete panel surface normally cause problems in finishing the surface of a panel through which they project. Our structural system, however, allows the inclusion of plumbing structures, if desired, in a panel in the same fashion as in traditional concrete tilt-up panels heretofore known.

The connecting elements 43 of any expansive strips, if used, are positioned on connecting elements 34, 35 of the lower fastening strip 28*b* or any desired individual expansive connecting elements 56 are established, if used. If desired, any additional auxiliary structural components 14 are added in the panel layer defined by the expansive connecting elements. Such auxiliary structural components may be supported directly on the expansive elements on supports 70 carried thereby to aid the positional maintenance of such components.

Upper surface element 28*a* of each fastening strip 13 is then established on the lower surface element 28*b*, or on intermediate connecting elements if used, by positioning the connecting elements in appropriate position and interconnecting them. Such positioning is accomplished by manual manipulation as the connecting elements will begin their interconnection quite easily by reason of their inter fitting conical configuration. Normally the interconnecting areas have been configured to create a frictional fit and, if additional force above that that can be directly manually applied is required to bring the fasteners into a completely connected state, such additional force may be created and applied by impact of an ordinary hammer since the lower fastening strip 28*b* is supported on the forming surface 46. It is possible that adjacent connecting elements may be fastened by adhesion, thermal welding or similar plastic fastening processes. The connecting elements may also be interconnected by establishing elongate fasteners such as screws or nails therebetween, but if this is done, it generally eliminates the use of the connecting elements involved from receiving other fasteners when in the completed panel. Normally auxiliary fastening beyond the frictional joinder of the connectors is not required or desirable.

It is to be noted in the method described for creating our panel elements for concrete pouring that no elongate rigid ancillary structural elements need be placed in the panel structure by threading them through the partially formed structure in an elongate fashion as generally is required in prior forming methods, but rather the forming structure is created in layers to allow the ancillary structural components to be positioned from above in a medial layer as the panel structure is created.

With the panel structure in its forming mode as described, concrete is placed in portions of the panel to be filled thereby. This concrete may be of known types heretofore used in the tilt-up panel art and may be placed and processed in the traditional fashion by the habitually familiar methods heretofore known and used for such purposes. The forming surface may be of a vibratory type and traditional de-airing, vibrating and compacting tools and machines may be used in the forming process to consolidate and de-air the concrete. The lower surface of the panel will be formed by the supporting surface of the forming slab. The upper surface of the panel is screened at the level of the upper surface of the peripheral elements and the coplanar surfaces of the upper fastening strips 29 and that upper panel surface is then finished by ordinary known concrete finishing methods.

After a poured panel has cured sufficiently for the concrete to gain appropriate strength, it is removed from the forming surface. The panel at this point will have peripheral elements 12, fastening strips 13 and any auxiliary structural elements 14 embedded within its structure to remain as a part of the panel for future use. The panel may be lifted from the forming surface and moved by means of the fastening or handling elements in the traditional and habitually familiar fashion by which tilt-up concrete panels are moved in the present day art dealing with them. Normally cranes are used for such moving and positioning and the panels are attached to the crane by a sling fastened to handling elements to move a panel without damage to or modification of the panel structure.

Tilt-up panels may be difficult to remove from a forming surface, depending upon various parameters such as the nature of a casting surface, its area, the nature of the concrete forming the panel and the like. The instant fastening strips 13 provide an added advantage to aid removal of a cast panel from its forming surface. The connecting elements 34, 35 all define interconnecting medial channels, with any covered channels being closed only by frangible removable covers. These channels may be opened completed through a cast panel, of necessary, by drilling, punching or similar manipulation and the open channel then provides a conduit for applying pneumatic or hydraulic pressure to the underside of a formed panel to aid removal from the forming surface. The application of such fluidic pressure commonly will cause the ready release of the panel, usually by an application from one medial position, but if not the fluidic pressure may be applied at various spaced positions over the panel as required.

Our panels may be joined by various methods heretofore used in the existing concrete tilt-up panel art. Such joinder usually is accomplished by pins or threaded studs 51 extending between adjacent panels and if such fasteners are used, holes or voids commonly are created in at least one panel in the formation process by removable cones to allow such joinder. A typical perpendicular corner connection is illustrated in the partial, horizontal cross-sectional view of FIG.

16. This illustration, however, is not intended to be limiting and is only one of various known methods for connecting precast concrete panels. The method of joining panels is only ancillary to the instant invention and is not a direct object or limitation of it, as our panel allows use of most if not all of the known methods for joining tilt-up concrete panels into a structure and does not limit those methods.

It should be noted that our panel and forming system may be used either for preforming concrete panels at a distant manufacturing plant for subsequent transportation to a use site or in forming such panels at a use site where they may be directly moved into desired structural position, and it provides the same benefits for either type of use. It should further be noted that the particular configuration and design of concrete panels to be formed by our system are not limited by our structures or forming processes, but rather panels may comprise the various traditional configurations and designs heretofore known therefore.

It is further to be noted that our panel provides a plurality of fastening areas not only about the panel periphery, but also about the periphery of orifices defined in it to accept ordinary fasteners to fasten mill work in the orifices.

Traditional self-penetrating fasteners of wood construction such as nails, screws, staples and the like may be embedded in any of the peripheral elements and fastening strips of our panels. Fasteners engaged in the fastening strips preferably are engaged in the channels defined by connecting element carried by those fastening strips for easier, stronger and more secure fastening. The positions of those connecting elements can be determined by the channels 32 extending through the surface elements of the fastening strips or, if channel orifices carry frangible covers, from indicia on positioning strips carried by exposed surfaces of the fastening strips. This type of fastening allows the use of almost any structural elements to be fastened to the panel. Ordinary stripping may be fastened to panel surfaces and subsequently used as a fastening structure for dry wall, external sheeting or other wall coverings, but generally sheeting may be fastened directly to fastening strips of the panel by traditional fasteners. If it be desired to place insulation on either side of the wall panel before placement of some covering element, the insulation may be fastened to all or selected connecting elements of the fastening strips.

The foregoing description of our invention is necessarily of a detailed nature so that a specific embodiment of its best known mode might be set forth as required, but it is to be understood that various modifications of detail, rearrangement and multiplication of parts, process and steps may be resorted to without departing from its essence, spirit or scope.

Having thusly described our invention, what we desire to protect by Letters Patent, and

What we claim is:

1. A structure supportable on a planar forming surface for formation of and embedment in a concrete panel for tilt-up wall construction comprising, in combination:

a plurality of rigid interconnected peripheral elements of similar extrudable cross-section, in coplanar array and having outer surfaces and inner surfaces, said peripheral elements forming peripheral edges and edges of optional internally defined orifices of the concrete panel to define a form for edges of panel concrete, said peripheral elements having coplanar upper and lower edges for positioning on the forming surface, first means for embedment of concrete facing surfaces in panel concrete for attachment thereto, second means for releasable attachment of form braces, to outer surfaces distal from panel concrete, third means for attachment of at least one fastening strip to extend between inner surfaces of at least two peripheral elements and fourth means for fastenably receiving self-penetrating fasteners of wood construction; and at least one elongate fastening strip, having at least one planar surface element with an outer outer surface coplanar with one coplanar surface of the edges of the peripheral elements, said at least said at least one fastening strip extending fastenably between two peripheral elements for positional maintenance and having means for fastenably receiving therein self-penetrating fasteners of wood construction.

2. The structure of claim 1 wherein the means for fastenably receiving self-penetrating fasteners of wood construction in structure elements comprise forming the peripheral elements and fastening strips from foamed polymeric material.

3. The structure of claim 1 wherein the means for embedment of concrete facing surfaces of the peripheral elements in panel concrete comprise paired opposed elongate channels defined in spaced relationship in the inner concrete facing surfaces of the peripheral elements, each channel of the pair angulated inwardly toward the opposed channel.

4. The structure of claim 1 having a plurality of form braces releasably fastened to the outer surfaces of the peripheral elements in spaced relationship for releasable fastening to the forming surface to positionally maintain the peripheral elements on the forming surface for forming concrete in the form defined by the peripheral elements.

5. The structure of claim 1 having concrete within the form defined by the peripheral elements.

6. The structure of claim 1 further characterized by each peripheral element having:

a medial body portion, with a plurality of spaced frangibly connected portions removable to define holes therethrough, connecting two similar spaced side elements, the inner surfaces of the side elements defining means for receiving and positionally maintaining end portions of fastening strips and the outer surfaces of the side elements defining spaced channels angulated in parallel relationship to receive fastening dogs of form braces for releasable interconnection.

7. The structure of claim 6 having a plurality of releasably interconnected form braces each comprising:

a planar base structurally supporting a perpendicularly extending vertical side with an angulated brace extending between the base and the vertical side, plural spaced fastening dogs carried by the vertical side distal from the base and angulated in parallel orientation to fastenably engage within the spaced angulated channels defined in the peripheral elements, and the planar base having means for releasable interconnection with the forming surface.

8. The structure of claim 1 wherein the fastening strips further comprise:

two elongate planar surface elements interconnected in spaced parallel relationship by a plurality of spaced, cooperating pairs of male and female connecting elements with one of each pair of connecting elements extending inwardly from interconnection with the opposed surface elements, said connecting elements of each pair having inter fitting inner portions to releasably interconnect the surface elements in spaced parallel adjacency.

9. The fastening strips of claim 8 further having continuous channels defined through the fastening strips and through the interconnected connecting elements and at least some connecting elements having at least one radially extending fin to support auxiliary structural components to be carried within panel concrete.

10. The fastening strips of claim 8 further having end portions of each surface element defining connecting means to interconnect an adjacent surface element in linear array and the outer surface of at least one surface element carrying an index tape to identify position of the surface element and positions of connecting elements extending therefrom.

11. The structure of claim 1 wherein the at least one fastening strip has one elongate surface element coplanar with a first planar surface through the edges of the peripheral elements with at least two spaced first connecting elements extending into the form spacedly distant from the second planar surface through the edges of the peripheral elements, with first connecting means in the inner end portions of the first connecting elements and a connecting strip in the form spacedly inward from the second planar surface through the edges of the peripheral elements having at least two spaced second connecting elements arrayed to interconnect with the at least two first connecting elements carried by the elongate surface element, said second connecting elements having inner end portions with second connecting means to interconnect with the first connecting means of the first connecting elements of the surface element and outer end portions extending substantially to the second planar surface through the edges of the peripheral elements.

12. The structure of claim 1 wherein the at least one fastening strip provides one elongate surface element coplanar with a first planar surface through the upper edges of the peripheral elements and having at least two spaced first connecting elements extending into the form spacedly distant from the second planar surface through the lower edges of the peripheral elements, with first connecting means in inner end portions of the first connecting elements and at least two second connecting elements each having at least three radially extending fins with legs, extending to the second planar surface, said second connecting elements extending inwardly into the form spacedly distant from the surface element and defining second connecting means to interconnect with the first connecting means of the at least two first connecting elements of the surface element.

13. A panel for tilt-up wall construction, comprising in combination:

a continuous concrete panel member with first and second substantially planar parallel sides, said concrete panel member defining peripheral edges and optional orifices;

a plurality of interconnected peripheral elements extending between the first and second sides of the concrete panel and forming the peripheral edges and edges of the optional orifices, each said peripheral element having means for embedment surfaces adjacent the concrete panel member in the concrete panel member to form an integrated panel and means for fastenably receiving self-penetrating fasteners of wood construction for attachment of construction materials to the peripheral elements.

14. The panel of claim 13 wherein the peripheral elements have means for attachment of at least one fastening strip extending between two peripheral elements and embedded in the concrete panel member and said fastening strip having at least one planar surface element with an outer surface coplanar with one planar side of the panel and means for fastenably receiving self-penetrating fasteners of wood construction for attachment of construction material to the at least one fastening strip.

15. The panel of claim 13 wherein the peripheral elements are arrayed with a continuous inner surface to create a form for the peripheral edges and optional orifice edges of the concrete panel member and have means for releasable attachment of form braces on the peripheral edges of the peripheral elements distal from the concrete panel member.

16. The panel of claim 14 wherein the at least one elongate fastening strip comprises two elongate planar surface elements interconnected in spaced parallel relationship by a plurality of spaced cooperating pairs of male and female connecting elements with connecting elements of each pair extending inwardly toward each other from interconnection with the opposed planar surface elements, said connecting elements of each pair having adjacent interfitting portions to interconnect the outer surfaces of each surface element in coplanar relation with the first and second panel sides.

17. The panel of claim 16 wherein the fastening strips further have interconnecting channels defined through the fastening strips and through the interconnected connecting elements and at least some connecting elements have fins to support auxiliary structural components carried within the panel concrete.

18. The panel of claim 14 wherein the surface element of the at least one elongate fastening strip carries an index strip on its surface coplanar with one panel side indicating position of the surface element and positions of connecting elements extending therefrom.

19. A panel for tilt-up wall construction formed partially of concrete with forming structure embedded therein, comprising in combination:

a continuous concrete panel member with first and second substantially planar parallel sides, said panel member defining peripheral edges and optional orifices;

a plurality of interconnected peripheral elements extending between the first and second sides of the concrete panel member and forming the peripheral edges and edges of optional orifices in the concrete panel member, each said peripheral element having means for embedment of sides adjacent the concrete panel member in the portion of the concrete panel member, means for fastenably receiving self-penetrating fasteners of wood construction to attach structural components to the panel, means for attachment of at least one fastening strip to attach structural components to the panel, and means for releasable attachment of form braces to positionally maintain the peripheral elements on an underlying planar forming surface; and at least one elongate fastening strip, extending between two peripheral elements and embedded in the panel concrete member, having at least one planar surface element with an outer surface coplanar with one planar side of the panel and means for fastenably receiving self-penetrating fasteners of wood construction to attach structural components to the at least one fastening strip.

20. The panel of claim 19 wherein the means for fastenably receiving self-penetrating fasteners of wood construction comprise forming the peripheral elements and the at least one elongate fastening strip from foamed polymeric material optionally embodying particulated cellulosic filling material to allow fastenable penetration of self-penetrating fasteners into the peripheral elements and at least one fastening strip.

* * * * *